US005735917A

United States Patent [19]

Inoue et al.

[11] Patent Number: 5,735,917

[45] Date of Patent: Apr. 7, 1998

[54] METHOD OF PROMOTING CARBONIZATION IN THE DOOR REGION OF A COKE OVEN AND OVEN DOOR THEREFOR

[75] Inventors: Keizo Inoue, Ibaragi; Hideyuki Kunimasa, Chiba, both of Japan

[73] Assignee: The Japan Iron and Steel Federation, Japan

[21] Appl. No.: 619,616

[22] PCT Filed: Aug. 2, 1995

[86] PCT No.: PCT/JP95/01536

§ 371 Date: Apr. 2, 1996

§ 102(e) Date: Apr. 2, 1996

[87] PCT Pub. No.: WO96/04352

PCT Pub. Date: Feb. 15, 1996

[30] Foreign Application Priority Data

| | | | |
|---|---|---|---|
| Aug. 2, 1994 | [JP] | Japan | 6-201446 |
| Apr. 18, 1995 | [JP] | Japan | 7-117867 |

[51] Int. Cl.[6] ..... C10J 3/00

[52] U.S. Cl. ..... 48/201; 202/248

[58] Field of Search ..... 202/248, 269; 110/173 R; 48/201

[56] References Cited

U.S. PATENT DOCUMENTS 601,468 3/1898 Hilgenstock ..... 202/248

FOREIGN PATENT DOCUMENTS

| | | |
|---|---|---|
| 60-32885 | 2/1985 | Japan . |
| 63-112686 | 5/1988 | Japan . |
| 5736 | 1/1993 | Japan . |
| 538795 | 6/1993 | Japan . |

OTHER PUBLICATIONS

International Search Report for PCT Application No. PCT/JP95/01536,, Nov. 14, 1995 (2 pp.)

*Primary Examiner*—Scott Kastler

*Attorney, Agent, or Firm*—Webb Ziesenheim Bruening Logsdon Orkin & Hanson, P.C.

[57] ABSTRACT

A gas passage is formed on the inner surface of an oven door of a coke oven. Combustible gas which is generated during carbonization of coal in the coke oven is introduced into the passage, an oxygen-containing gas is introduced into the gas passage from a nozzle installed on the sole plate of the door region, ingress of charged coal into the gas passage is prevented, the combustible gas is combusted in the gas passage, a decrease in temperature in the door region common in the prior art is made up for, and the carbonization of coal is thereby promoted.

10 Claims, 5 Drawing Sheets

METHOD OF PROMOTING CARBONIZATION IN THE DOOR REGION OF A COKE OVEN AND OVEN DOOR THEREFOR

TECHNICAL FIELD

This invention relates to a method for promoting carbonization in a door region and to the structure of an oven door which overcomes nonuniform carbonization during manufacture of coke in a chamber oven.

BACKGROUND OF THE INVENTION

As is well known, a method for manufacturing coke using a chamber oven is a method in which a carbonizing chamber is charged with coal and is heated by heat coming from combustion chambers on both of its sides through brick walls. It is known that coke which is manufactured by this method varies greatly in quality in the length, height, and width directions of the carbonizing chamber. Recently, increasing the effectiveness of carbonization in a coke oven and stabilizing the quality of coke have come to be considered very important, and improving the quality within carbonizing chambers and improving the carbonizing temperature have become important topics. In particular, as for the variation in quality of coke and variation in carbonization temperature in the lengthwise direction of an oven, there is a marked degree of variation in these properties in the door regions at the pusher side where coke is pushed and the coke side where coke is discharged, so unless an improvement in the nonuniform carbonization at these door regions is devised, it can be said that efficient carbonization and stabilization of the quality of coke in a coke oven are impossible.

FIG. 1 is a partially cross-sectional schematic view of a chamber oven 10. Normally, the carbonizing chamber 12 of a chamber oven 10 is formed from a space which is elongated in the horizontal direction having a length of 13–17 meters, a height of 4–7.5 meters, and a width of 0.4–0.5 meters and having an oven door 18 installed on the door region 16 on the rear side and the door region 16 on the front side. In order to make it easier for an unillustrated pusher to push coke to the outside of the oven after the completion of carbonization, the door region on the coke side has an increased width on the order of 50–80 mm.

As shown in the partially cross-sectional plan view in FIG. 2, an oven door 20 elongated in the vertical direction is installed on the door region 16. This oven door 20 is formed from a main metal frame 20*a* on the exterior, interior metal frame 20*b* connected thereto, and a heat insulating material 23 secured to the interior metal frame 20*b*. Whenever coke is pushed through the chamber, the doors 20 in the rear and front door regions 16 are removed and the door regions are exposed to the external air, and there is much heat dissipation. In addition, when coke is being pushed, the oven door 20 contacts the outside air and is cooled, and there is also much heat dissipation to the outside air from the oven door 20 itself which is again installed after the completion of coke pushing. As a result, the temperature of the door region falls by almost 100 degrees C. with respect to the average temperature of each combustion chamber.

For this reason, the charged coal in the vicinity of the oven ports is coked more slowly than coal at the center of the oven, so nonuniform carbonization is unavoidable.

As a means of solving the problems of nonuniform carbonization at the door regions, i.e., oven ports, countermeasures have been attempted such as increasing the amount of fuel gas supplied to the region of the combustion chamber adjoining the door regions compared to other portions or increasing the calories of the fuel gas to increase the temperature. However, there is a limit to how much the temperature of the combustion chamber can be increased, and conditions have not yet reached the point that an adequate effect has been achieved.

A method has been proposed in which the water content of the coal charged in the door regions is lowered with respect to the water content of coal charged in the center (Japanese Published Unexamined Patent Application No. Sho 60-32885). This method has been affirmed in principle, but a practical method has not been established for charging coal of different water contents into the door regions and the center of a carbonizing chamber, so this method is not practical.

As shown in FIG. 3, as an active measure with respect to the oven door, an oven door has been proposed in which the main metal frame 32 of an oven door 30 is lined with an insulating material 33, a heat resistant plate 35 is installed thereon through connecting members 34, and a gas conduit 36 for promoting the discharge of coke oven gas which is generated during carbonization in the space between the insulating material 33 and the heat resistant plate 35 is provided in the vertical direction. Air or oxygen is introduced through the gas conduit 36 via a pipe 37, coke oven gas is combusted, and heat is actively increased. See Japanese Published Examined Patent Application No. Hei 5-38795(Japanese Published Unexamined Patent Application No. Sho 63-112686).

SUMMARY OF THE INVENTION

As the heat resistant plate 35 of the oven door 30 disclosed in the above-mentioned Japanese Published Examined Patent Application No. Hei 5-38795, stainless steel is generally used for reasons of economy, but due to problems such as heat deformation and corrosion, its durability is inadequate. A ceramic material which has durability has also been tried, but not only is it expensive, but it has poor impact resistance, so it cannot stand up to actual use. Furthermore, the connecting members 34 are directly exposed to high temperature combustion gases which are combusted by air or oxygen from the outside of the oven, so they are subjected to thermal deformation or corrosion, and there is a problem with respect to their durability. In addition, in order to avoid contact trouble at the time of removal or installation of the oven door, a prescribed gap is left between the heat resistant plate 35 and the oven wall 38, but as the heat resistant plate 35 is thin, a portion of the charged coal can enter the gas conduit 36 from this space, turn to coke, and stick to the oven wall or other portion, so not only does it become impossible to smoothly perform removal and attachment of the oven door, but a large portion falls and piles up in the door regions, and this may be an impediment to discharge of coke. This tendency is particularly prominent with respect to today's humidity controlled coal operations.

Moreover, with this oven door structure, coke oven gas which passes through the gas passage unavoidably directly contacts the metal door frame, and a considerable portion of the heat which is generated by gas combustion within the gas passage is dissipated to the outside through the door frame. Thus such dissipated heat can not be effectively used in improving carbonization in the door regions, and it leads to an increase, through the door frame, in the temperature of a protective plate which is normally a cast metal, and due to expansion damage of the protective plate, there is a great possibility of heavy damage to the oven body. For these reasons, this structure has not reached the point of actual use.

The object of the present invention is to solve problems like those described above of conventional oven doors and to provide a method of prompting carbonization in a coke oven door region which can effectively prevent the ingress of charged coal into a gas passage which is an impediment to oven operation and can do away with the delay in coke carbonization in the above-described door regions.

The present inventors performed various experimental research for the purpose of achieving the above-described object. As a result, they found that if a plurality of heat resistant members having a nearly concave cross section and sloping surfaces at their upper and lower ends are fitted to form a closed space with a space left between the neighboring heat resistant members, a gas passage can be formed in the main metal frame of an oven door through a heat insulating material, ingress of charged coal into the gas passage can be prevented and the flow of coke oven gas from the carbonizing chamber to the gas passage can be guaranteed, stabilized combustion is possible by blowing air or oxygen, and the dissipation of heat to the door frame can be prevented, thereby completing the present invention.

Namely, the present invention is a carbonizing promoting method for a coke oven door region and an oven door structure therefor, characterized in that combustible gas which is generated during carbonizing of coal in a coke oven (hereunder also referred to simply as coke oven gas) and an oxygen-containing gas are introduced into a gas passage formed on the inner side of an oven door of a coke oven, the ingress of charged coal into the gas passage is prevented, the combustible gas is combusted in the gas passage, and the carbonizing of coal in the door regions is promoted.

According to another aspect, the present invention is a carbonizing promoting method for a coke oven door region and an oven door structure therefor, characterized in that a plurality of heat resistant members having a nearly concave, i.e., channel-like, or cylindrical cross section and sloping surfaces at their upper and lower ends are fitted to form a closed space with a space left between the neighboring heat resistant members, a gas passage is formed in the main metal frame of an oven door through a heat insulating material, and oxygen-containing gas is blown into the gas passage and coke oven gas is combusted.

According to yet another aspect, the present invention is a carbonizing promoting method for a coke oven door region and an oven door structure therefor, characterized in that a heat insulating material is provided on the inner side of main metal frame of an oven door of a coke oven, and then a vertically extending gas passage is formed using heat resistant members which have a cross section which is generally cylindrical or concave and which has a side portion thickness which is greater than the front portion thickness, the joint with the insulating material is sealed so that charged coal can not enter the gas passage, an oxygen-containing gas is blown into the gas passage, and a portion of the coke oven gas which is generated during carbonizing is combusted.

According to a preferred mode of the present invention, a heat insulating material is provided on the inner side of main metal frame of an oven door of a coke oven, then a plurality of heat resistant members containing reinforcing fibers and having a cross section which is generally cylindrical or concave and having a side portion which is thicker than the front portion and having an upper end surface which slopes outward and a lower end surface which slopes inward are vertically aligned in series, the sloping surfaces of the upper and lower ends of the heat resistant members are made to face each other with a space in between and are secured to the main metal frame with a connecting member through the heat insulating material to form a gas passage extending vertically, the joints with the heat insulating material are sealed to prevent ingress of the charged coal into the gas passage, an oxygen-containing gas is blown into the gas passage, and a portion of the coke oven gas which is generated during carbonizing of the charged coal is combusted.

Thus, it is extremely effective to introduce coke oven gas from the inside of the oven and an oxygen-containing gas from the outside of the oven into the gas passage formed on the inner side of the oven door, and they are combusted in order to overcome nonuniform carbonizing in the door regions. However, in this method, the manner of blowing air or oxygen into the gas passage from the outside is extremely important.

Normally, when the coke is discharged, an oven door is removed from the oven. Accordingly, since piping is installed directly on the oven door to blow an oxygen-containing gas it is necessary to remove and install the piping each time the oven door is detached or attached. For this reason, actual operation with such a structure is extremely time-consuming, and when the operating time efficiency is high, there is the possibility of the time required for this operation affecting productivity adversely.

Thus, according to a more preferred mode of the present invention, attention is focused on the sole plate of the door opening of a coke oven, and by blowing air or oxygen from the sole plate of the door opening into a gas passage formed in the oven door, oxygen-containing gas such as air or oxygen can be easily blow from the outside into the gas passage formed in the oven door, without being affected by detachment or attachment of the oven door.

Namely, according to another aspect, the present invention is a carbonizing promoting method for a coke oven door region and an oven door structure therefor in which coke oven gas which is generated during carbonization of coal in a coke oven is introduced into a gas passage formed on the inner side of an oven door, air or oxygen is blown during carbonization and the coke gas is combusted and the carbonization of coal in the door region is promoted, characterized in that an oxygen containing gas is blown into the gas passage from a location in the door region facing the lower end of the oven door, such as the sole plate of the coke oven door opening.

According to the present invention, a portion of coke oven gas is combusted in the gas passage by an oxygen containing gas, such as air or oxygen, which is blown from a blowing nozzle, and it is advantageous to keep the temperature in the gas passage at 600° C. or higher because the coke oven gas which is generated during carbonization has a tar component, and at a temperature of 600° C. or below, a portion thereof condenses and there is a fear of hollow portions of the carbonizing chamber or the gas passage becoming blocked. In order to prevent the formation of black smoke and dust at the time of coke discharge due to inadequate carbonization and to guarantee shrinkage of the coke, the temperature of the coke side door region in the last stages of carbonization is preferably at least 700° C. There is no particular upper limit on the temperature of the gas passage as long as such a temperature can be guaranteed, but it can be determined taking into consideration the extent of worsening of the sealing ability due to thermal strains of the main metal frame of the oven door which accompanies an increase in temperature.

BEST MODE FOR CARRYING OUT THE INVENTION

Details of the present invention will be explained based on FIG. 4 through FIG. 6.

Figure 4:
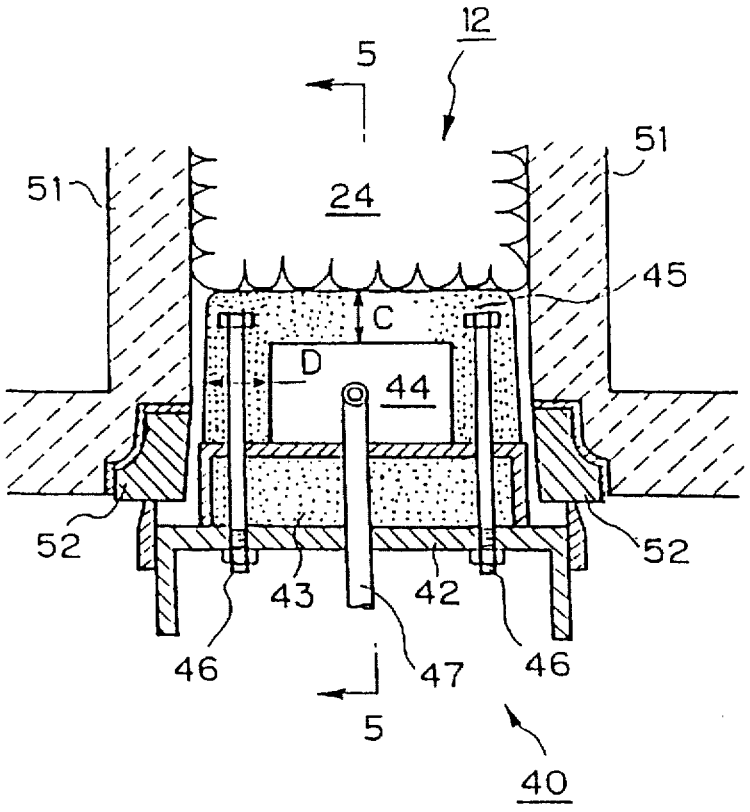
FIG. 4 is a schematic horizontal cross-sectional view of an embodiment of this invention.
Figure 5:
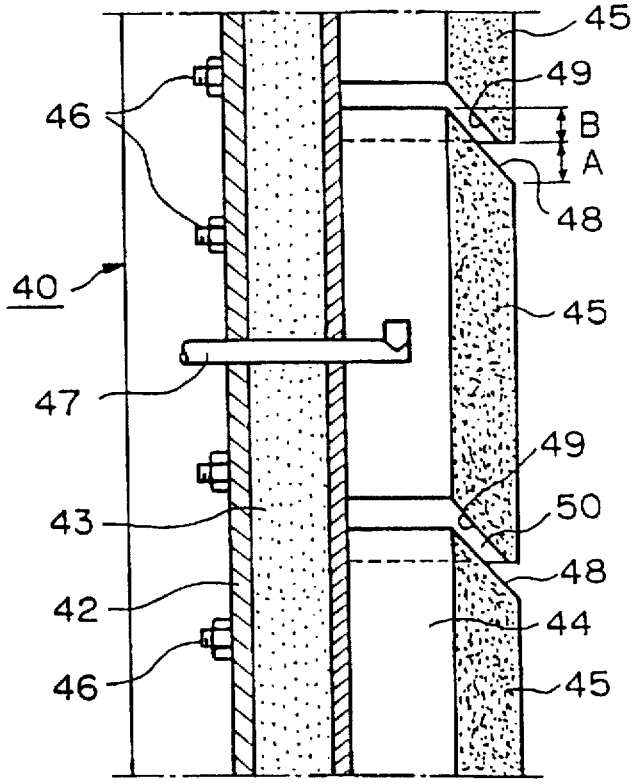
FIG. 5 is a view taken along line a—a of FIG. 4.
Figure 6:
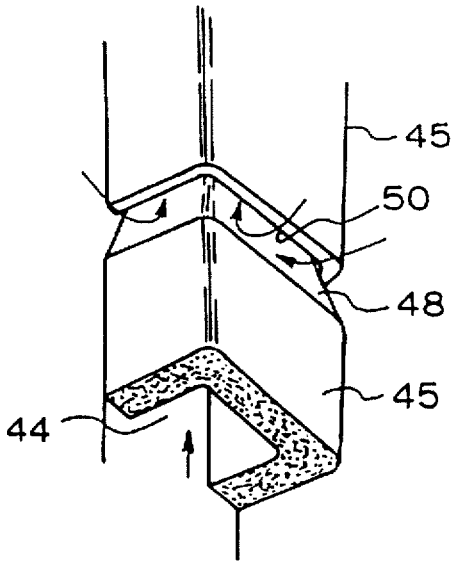
FIG. 6 is a schematic view of one embodiment of a fitted joint of heat resistant members according to this invention.

FIG. 4 is a schematic horizontal cross-sectional view of an oven door used in the method of the present invention, FIG. 5 is a view taken along line a—a of FIG. 4, and FIG. 6 is a schematic view showing the fitting of a heat resistant member used in the method of the present invention. An oven door is provided on the door opening on both the pusher side and the coke side, but the following explanation will not distinguish between the two doors and will refer simply to an oven door.

As is clear from the illustrated example, the oven door 40 is formed from main metal frame 42, a heat insulating material 43, a heat resistant member 45 having a cylindrical or concave cross-sectional shape and which forms a gas passage 44 in its interior, a connecting member 46 which intimately fixes the heat resistant member 45 to the heat insulating material 43, and a blowing nozzle 47 which blows air into the gas passage 44.

The heat resistant member 45 is preferably formed of a castable mixed with reinforcing fibers such as all types of steel fibers, carbon fibers, or ceramic fibers. In order to prevent the ingress of charged coal into the gas passage 44, as shown in FIGS. 5 and 6, the upper end surface is made an outwardly facing sloped surface 48, the lower end is made an inwardly facing sloped surface 49, a plurality of heat resistant members 45 are aligned in the vertical direction and the sloping surfaces on the upper and lower face each other across a gap 50, the gap A between each heat resistant member 45, 45 is preferably made at most 50 mm, the overlapping portion B is preferably made at least 50 mm, and the heat resistant members are preferably secured to the heat insulating material 43 by a connecting member 46.

The gap A between the heat resistant members 45, 45 is made at most 50 mm because it was confirmed by tests that if the gap is greater than this amount, ingress of charged coal into the gas passage 44 cannot be adequately prevented. In addition, from the standpoint of maintaining gas flow between the gas passage 44 and the carbonizing chamber, the gap A between the heat resistant members 45 is preferably made as wide as possible below the upper limit of 50 mm. The reason why the overlap B between the heat resistant members 45, 45 is made at least 50 mm are required to prevent ingress of charged coal into the gas passage 44.

Figure 1:
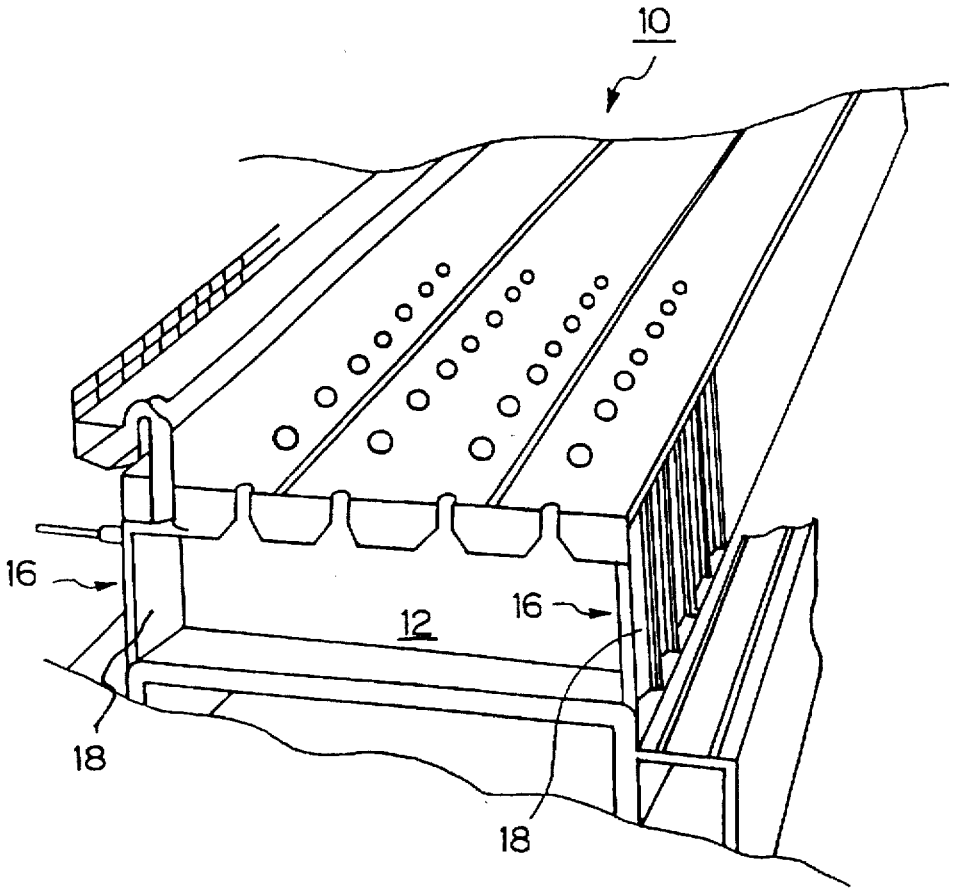
Fig. 1 (Prior Art)
FIG. 1 is a schematic explanatory view of a carbonizing chamber of a coke oven.
Figure 2:
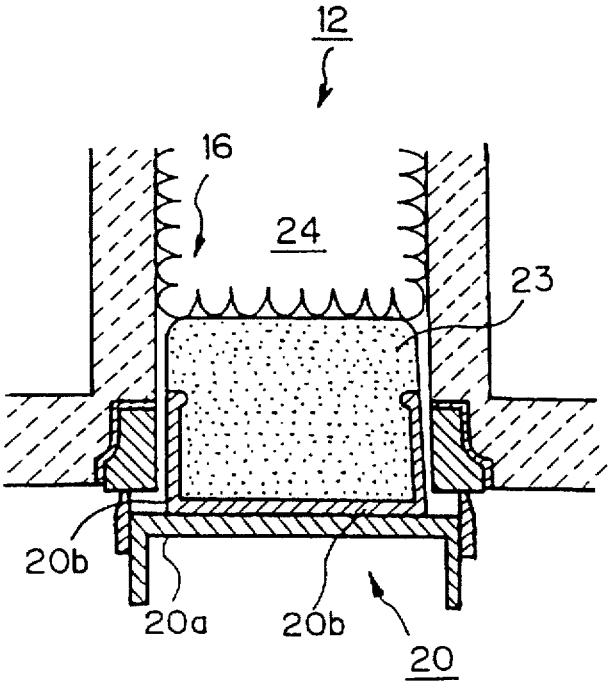
Fig. 2 (Prior Art)
FIG. 2 is a schematic horizontal cross-sectional view showing an example of a conventional oven door structure.

The separation between the oven wall 51 of the carbonizing chamber 12 and the heat resistant members 45 can be set to the same value of 10–20 mm as generally used in the conventional oven door of FIG. 2.

According to a more preferred mode of the present invention, the heat resistant member 45 has a side portion thickness D which is greater than the front portion thickness C. The heat which is obtained by combustion of the coke oven gas in the gas passage 44 is, therefore, effectively transmitted to the coal layer 24 within the carbonizing chamber, the transmission of heat to the oven wall 51 is reduced, and the loss of heat from the door frame 52 is suppressed. The ratio of the side portion thickness D to the front portion thickness C of the heat resistant member 45 varies depending upon the heat insulating capability of the heat insulating member 45, but in general if D/C is at least 2, the loss of heat to the door frame 52 can be minimized. In order to reduce the heat capacity, a small front portion thickness C is preferable, and it can be suitably selected from a range in which a prescribed degree of strength is obtained.

The oxygen-containing gas blowing nozzles 47 for blowing air, oxygen, etc. into the gas passage 44 (hereunder sometimes referred to simply as air blowing nozzles) are constructed so as to blow an oxygen-containing gas such as air or oxygen and ignite and combust coke oven gas which flows from the spaces 50 between the heat resistant members 45, 45 into the gas passage 44. An unillustrated ignition apparatus such as a spark plug is mounted on the ends of the air blowing nozzles 47.

Due to the above-described construction, coke oven gas which flows into the gas passage 44 through the gaps 50 between the outwardly facing sloped surfaces 48 and the inwardly facing sloped surfaces 49 of the heat resistant members 45, 45 is combusted by the oxygen gas blown into the gas passage 44 by the air blowing nozzles 47, and as the gas is being carried to the upper space by the chimney effect of the gas passage 44, the heat of combustion is transmitted to the charged coal 24 within the carbonizing chamber through the front surfaces of the heat resistant members 45, the charged coal 24 contacting the front surfaces of the heat resistant members 45 is heated, and carbonization is promoted.

By making the side portion thickness D greater than the front portion thickness C of the heat resistant members 45, the heat which is obtained by combustion of the coke oven gas which penetrates the gas passage 44 is effectively transmitted to the charged coal 24 within the carbonizing chamber, heat transmission to the oven wall 51 is decreased, and loss of heat through the door frame 52 can be suppressed.

Figure 7:
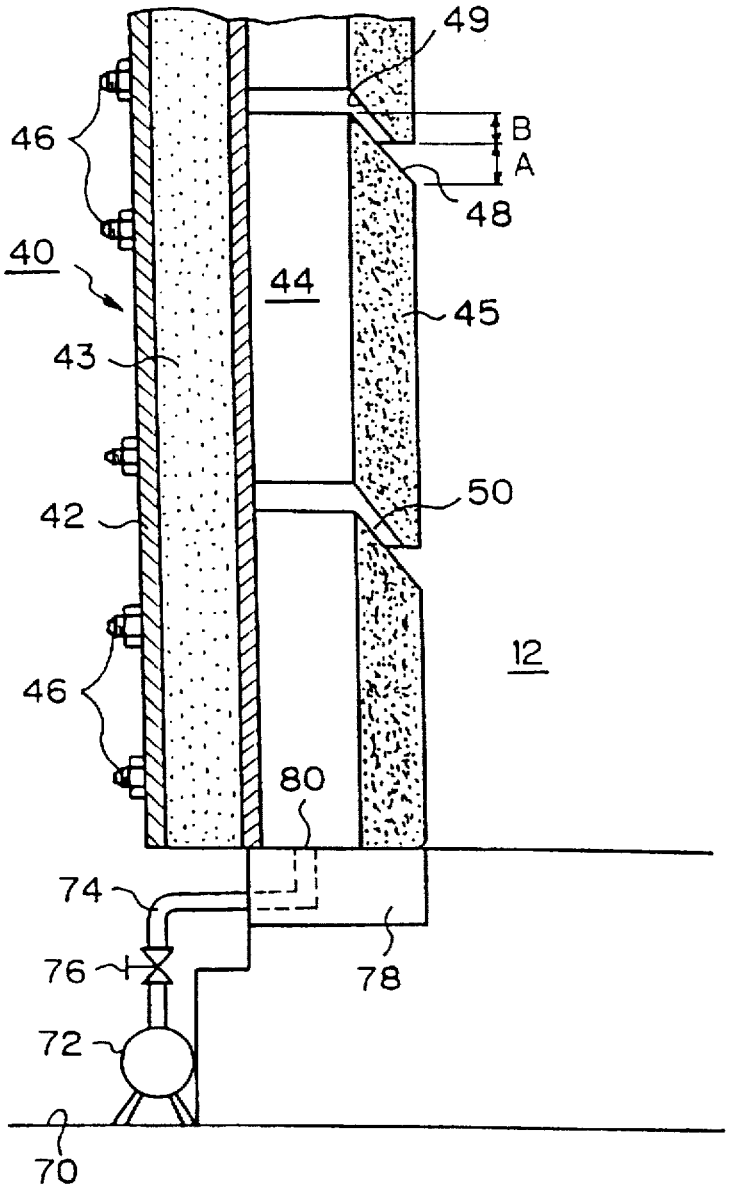
FIG. 7 is a schematic explanatory view showing the installation of an air or gas supply nozzle of the sole plate in another embodiment of the present invention.

FIG. 7 shows another variation of the present invention. According to this variation, an oxygen-containing gas inlet is provided in the door region facing the lower end of the oven door. Namely, as shown in the figure, air piping 72 is provided on the operating deck 70 at the lower portion of the door region of a carbonizing chamber 12 along a row of coke ovens, a shutoff valve 76 is provided on a branch pipe 74 from the air piping 72, and the end of the branch pipe 74 passes through the sole plate 78 and forms a nozzle opening 80 which opens into the gas passage 44. Accordingly, if the valve 76 is opened, air passing through the sole plate 78 can be blown into the gas passage 44 of the oven door 40 through the nozzle opening 80, and coke oven gas which flows into the gas passage 44 through the gaps between the heat resistant members 45, 45 can be ignited and combusted. In this case as well, an ignition apparatus such as an unillustrated spark plug is provided on the tip of the nozzle 80.

In this manner, the supply of air (oxygen) to the gas passage 44 in the oven door 40 is carried out via the valve 76 through the branch pipe 74 which branches from the air piping 72 which is installed on the operating deck 70 along the row of coke ovens. The sole plate 78 is integrated with the carbonizing chamber 12, so the blowing of oxygen-containing gas can be carried out without being troubled by the detaching and attaching of the oven door 40.

According to the present invention, a heat resistant member which is exposed to high temperature and is pressed by charged coal has good resistance to thermal deformation and corrosion and has excellent durability, and in addition, due to the use of a castable, it has increased durability and economy.

By making the side portion thickness of the heat resistant member greater than the front portion thickness, the heat which results from combustion of coke oven gas in the gas passage can be effectively transmitted to the coal charged inside the carbonizing chamber, the transmission of heat to the oven wall is reduced, and heat loss through the door frame can be suppressed.

Furthermore, if the connecting member to the main metal frame is embedded in the castable of the heat resistant material, it is not exposed to high temperature combustion gas, and its durability can be maintained. In addition, the heat resistant members which are in intimate contact with the heat insulating material form a box-shaped gas passage, and the sloping surfaces at the upper and lower ends of the heat resistant members are installed so as to oppose each other across a gap, so ingress of coal into the gas passage from a carbonizing chamber in which the coal having been charged by gravity can be prevented, and the flow of coke oven gas from the carbonizing chamber into the gas passage can be guaranteed. As a result, stable combustion of coke oven gas by air or oxygen is possible.

In the above-described mode of the present invention, by blowing oxygen-containing gas such as air or oxygen into the gas passage from a location opposing the bottom of the oven door of the coke oven door region, such as from the sole plate, it is not necessary to remove and install the piping each time the oven door is detached or installed, and when the oven door is detached or attached, special labor or the installation of special equipment is not necessary, so coke gas can be combusted in the gas passage formed in the oven door as desired, there is no effect on the coke discharged operation of the coke oven, the obtained heat is effectively transmitted to the coal within the carbonizing chamber, heat transmission to the oven wall is reduced, heat loss through the door frame can be suppressed, and promotion of carbonization in the coke oven door regions can be achieved.

[EXAMPLES]

Example 1

Figure 3:
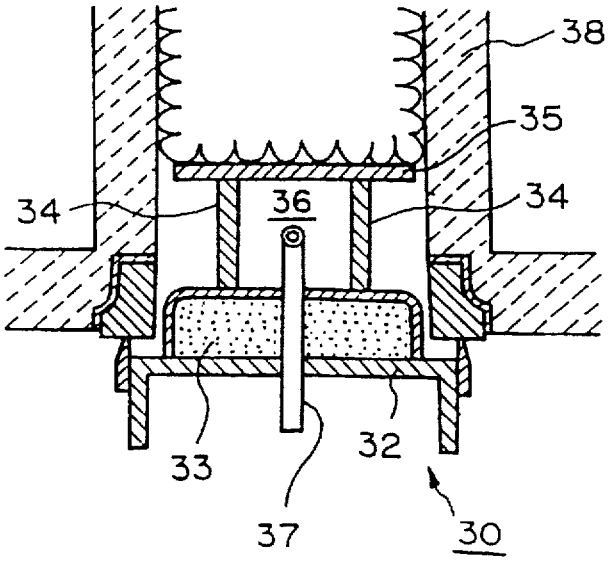
Fig. 3 (Prior Art)
FIG. 3 is a schematic horizontal cross-sectional view showing another example of a conventional oven door structure.

In a coke oven measuring 7,125 mm high, 460 mm wide, and 16,500 mm long, under controlled humidity operating conditions with an operating time efficiency of 95%, an average combustion chamber temperature of 1038° C., a water content of 6.1% in the charged coal, and an average bulk density of 780 kg/m$^3$ for the charged coal, the oven door for the door region on the pusher side was varied among that shown in FIG. 4 (two examples of the present invention), that shown in FIG. 2 (Comparative Example 1), and that shown in FIG. 3 (Comparative Example 2). The temperature rise of the coke, the time required for coking, the generation of black smoke from the oven door, and ingress of charged coal into the gas passage were investigated.

The dimensions and materials of the various oven doors are shown in Table 1.

In order to investigate the increase of temperature of coke in the door region, a temperature sensing hole was formed in the center of each oven door at a location 3 meters above the oven bottom, and the temperature of the end surface of the charged coal layer or coke layer which contacted the oven door and the temperature of the gas passage were measured.

In the case of FIG. 4 (2 examples of the present invention) and FIG. 3 (Comparative Example 2), an air blowing nozzle for combustion was installed in a location 30 cm from the bottom of the oven door, an ignition apparatus generating an electric spark was provided on the end of the nozzle, a portion of the coke oven gas which was generated during carbonization was combusted beginning 2 hours after charging of coal, and the temperature in the gas passage was maintained at 800° C.

The experimental results are shown in Table 2.

TABLE 1

| | Overall | Heat Insulating Material | | Gas Passage | Heat Resistant Members | |
|---|---|---|---|---|---|---|
| | Thickness (mm) | Thickness (mm) | Material | Width (mm) | Thickness (mm) | Material |
| Example 1 (Present Invention) | 350 | 150 | Ceramic Fibers | 130 | Front (C) 70 Side (D) 150 | Castable containing stainless steel wire |
| Example 2 (Present Invention) | 350 | 150 | Ceramic Fibers | 130 | Front (C) 70 Side (D) 70 | Castable containing stainless steel wire |
| Comparative Example 1 (Conventional Oven Door) | 350 | 350 | Refractory Brick | — | — | — |
| Comparative Example 2 | 350 | 150 | Ceramic Fibers | 190 | 10 | Stainless Steel |

TABLE 2

| | Coking Time (hr) | Temperature of End Surface of Coke (°C.) | Door Frame Temperature (°C.) | Bake Stay Temperature (°C.) | Gas Leaks | Ingress of Coal (Kg) |
|---|---|---|---|---|---|---|
| Example 1 (Present Invention) | 20.6 | 814 | 253 | 131 | None | None |
| Example 2 (Present Invention) | 20.9 | 799 | 291 | 155 | None | None |
| Comparative Example 1 (Conventional Oven Door) | 22.8 | 561 | 216 | 114 | Leaks Occurred | None |
| Comparative Example 2 | 21.3 | 783 | 382 | 231 | None | 62 |

As shown in Table 2, during coke discharge, the temperature of the end surface of the coke in the door region which contacted the oven door was 561° C. for the conventional oven door of Comparative Example 1, and it cannot be said that an adequate temperature for coking was reached. This was also confirmed by visual observation at the time of coke discharge. During charging under controlled humidity conditions, the pressure in the door region increases, and as a result, with the conventional oven door of Comparative Example 1, gas leaks were observed.

In contrast, in Examples 1 and 2 of the present invention, it was confirmed that the temperature of the coke end surface reached 814° C. and 799° C., which are adequate temperatures for the formation of coke. Although the temperatures of the door frame and the back stay both slightly increased, they did not reach temperatures within a range which could cause a variation in operational results. In addition, no gas leaks were observed at all, and ingress of coal into the gas passage was also not observed at all.

On the other hand, in Comparative Example 2, although the temperature of the end surface of the coke increased compared to that of the conventional oven door of Comparative Example 1, it did not reach the level of Examples 1 and 2 of the present invention. In addition, the door frame temperature and the back stay temperature were both much higher than for a conventional oven door. Although no gas leaks were observed at all, there was very much ingress of coal into the gas passage, and it was of an amount that could not be permitted during normal operation.

Due to the fact that the rise in the temperature of the door region was fast and the delay in carbonizing was overcome in the examples of the present invention, the time required for coking was 20.6 hours for Example 1 and was 20.9 hours for Example 2 of the present invention, both of which are large improvements. It was 2.2 hours less than for the conventional method of Comparative Example 1 and was 0.7 hours less than for Comparative Example 2, confirming that the method of the present invention provides significant effects.

Example 2

In this example, a nozzle for blowing oxygen-containing gas was installed on the sole plate of the door region on the pusher side, as shown in FIG. 7.

Namely, in a coke oven measuring 7,125 mm high, 460 mm wide, and 16,500 mm long, under controlled humidity operating conditions with an operating time efficiency of 100%, an average combustion chamber temperature of 1053° C., a water content of 6% in the charge coal, and an average bulk density of 780 kg/m$^3$ for the charged coal, as shown in FIG. 7, an oven door according to this invention equipped with a nozzle for blowing an oxygen-containing gas on the sole plate or a conventional oven door of the type used in Example 1 and shown in FIG. 2 were installed, and the rise in temperature of the coke and coking conditions were investigated in a location 3.5 m above the oven bottom and 100 mm from the side of the oven door.

When using an oven door according to the present invention, air was blown from the sole plate of the coke oven door region from 10 hours after the start of carbonizing until 20 hours after the start of carbonizing, coke oven gas was combusted in the gas passage, and the temperature in the gas passage was maintained at 830° C.

The results are shown in Table 3.

TABLE 3

| | Coking Time (hr) | Coke Temperature 100 mm from the side of oven door (°C.) | Door Frame Temperature (°C.) | Back Stay Temperature (°C.) |
|---|---|---|---|---|
| Present Invention | 19.4 | 782 | 218 | 110 |
| Comparative Example | 21.6 | 555 | 220 | 119 |

As shown in Table 3, the coke temperature at a location 100 mm from the side of the oven door at the time of coke discharge was 555° C. and inadequate for carbonization for the conventional oven door of the comparative example. It cannot be said that an adequate temperature for coke formation was reached, and the generation of black smoke was visually observed at the time of coke discharge. In contrast, in the example of the present invention, the temperature of the coke end surface reached 782° C. which is sufficient for coke formation, no black smoke was ascertained during visual observation at the time of coke discharge, and due to the increased thermal insulation, the temperatures of the door frame and the back stay were lower than for the conventional oven door.

Due to the fact that the rise in the temperature in the door region was fast and the delay in carbonizing was overcome in the examples of the present invention, the time required for coking was 19.4 hours for the example of the present invention and was greatly improved compared to the 21.6 hours for the conventional oven door.

As described above, according to the method of the present invention in which air or oxygen is blown into a gas passage formed by heat resistant members made from a castable in which reinforcing fibers are mixed and which are fit together with an air gap therebetween and which are installed on the main metal frame of an oven door, ingress of charged coal into the gas passage can be prevented and the flow of gas from the carbonizing chamber into the gas passage can be guaranteed, and by stably combusting using air or oxygen a portion of the gas which is generated during carbonizing, the fear of heat loss from the oven body accompanying a rise in temperature of the door frame is done away with, effective heating of coal in the door region becomes possible, and uniformizing of carbonization, an increase in productivity, a decrease in the amount of heat required for carbonization, and an improvement in the quality of coke can be achieved, and the present invention makes a large contribution to an increase in the efficiency of a coke oven and stabilization of coke quality.

In addition, the pressure on the door region during charging of coal can be decreased, and the present invention also exhibits the excellent effects from the standpoint of improving the environment in that gas leaks and the generation of black smoke can be prevented.

We claim:

1. A method for promoting carbonization in a door region of a coke oven comprising the steps of providing a gas passage formed on an inner side of the coke oven door, introducing into said gas passage a combustible gas which is generated during carbonization of coal in the coke oven and introducing an oxygen containing gas into said gas passage, preventing ingress of charged coal into the gas passage and combusting the combustible gas in the gas passage, whereby carbonization of coal in the door region is promoted.

2. A method for promoting carbonization in a door region of a coke oven, comprising the steps of providing a plurality of heat resistant members having a substantially concave cross section wherein said members fit together with gaps between sloping surfaces on respective upper and lower ends of adjacent heat resistant members, providing a heat insulating material on a main metal frame of an oven door to form a closed space with the gaps remaining, introducing an oxygen containing gas into a gas passage defined by the closed space formed by the heat resisting members, introducing into said gas passage through said gaps a combustible gas which is generated during carbonization of coal in the coke oven and combusting said combustible gas and oxygen in the gas passage.

3. A method for promoting carbonization in a door region of a coke oven, comprising the steps of providing a heat insulating material on the inner side of the main metal frame of an oven door of a coke oven, forming a gas passage extending in the vertical direction using a plurality of heat resistant members having a substantially concave cross section wherein said heat resistant members each have a side portion thickness which is greater than a front portion thickness, wherein between said members and joints the heat insulating material of the oven door are sealed to prevent an ingress of charged coal into the gas passage, introducing an oxygen containing gas into the gas passage, and combusting a combustible gas which is generated during carbonization of coal in the coke oven with said oxygen in the gas passage whereby a greater amount of heat generated in said combusting step passes through the front portions of said heat resistant members than through said side portions.

4. A method for promoting carbonization in a door region of a coke oven, comprising the steps of providing a gas passage formed on the inner side of an oven door of the coke oven, introducing a combustible gas which is generated during carbonization of coal in the coke oven into the gas passage and introducing an oxygen containing gas into the gas passage through a main body of the oven door, preventing ingress of charged coal into the gas passage, combusting the combustible gas within the gas passage, whereby carbonization of coal in the door region is promoted.

5. A coke oven door comprising a plurality of members for forming a gas passage on the inner side of the oven door body of a coke oven, said members having inlets to permit the ingress of a combustible gas from the coke oven into the gas passage, said inlets being sloped upward from an outside to an inside of the gas passage, and inlet means for introducing an oxygen containing gas into said gas passage, whereby combustion of said combustible gas occurs in said gas passage.

6. The coke oven door according to claim 5 wherein the members for forming the gas passage have slit shaped inlets for the ingress of a combustible gas.

7. The coke oven door according to claim 5 wherein the members for forming the gas passage have a side portion thickness which is at least 2 times a thickness of a front portion which adjoins a charged coal layer whereby a greater amount of heat generated by the combustion of said combustible gas passes through the front portion of the gas passage forming members than through the side portion.

8. The coke oven door according to claim 5 wherein the members for forming the gas passage have an upper end surface and a lower end surface, each end surface formed with an upward slope extending from an outside to an inside surface of said member, said members having a cylindrical or nearly concave cross section, and wherein the members are vertically aligned and spaced apart to define a gap between each end surface which serves as the inlets for ingress of said combustible gas into the gas passage.

9. The coke oven door according to claim 5 wherein the inlet means for introducing the oxygen containing gas is disposed in a door region facing a bottom end of the oven door.

10. The coke oven door according to claim 9 wherein the inlet for oxygen containing gas is provided on a sole plate of the door region.

* * * * *

UNITED STATES PATENT AND TRADEMARK OFFICE

CERTIFICATE OF CORRECTION

PATENT NO. : 5,735,917

DATED : April 7, 1998

INVENTOR(S) : Keizo Inoue and Hideyuki Kunimasa

It is certified that error appears in the above-identified patent and that said Letters Patent is hereby corrected as shown below:

Column 2 Line 32 delete --SUMMARY OF THE INVENTION--.

Column 3 between lines 3 and 4 insert --SUMMARY OF THE INVENTION--.

Column 4 Line 35 "be easily blow" should read --be easily blown--.

Column 5 Line 3 "DRAWING" should read --DRAWINGS--.

Column 5 Lines 23-24 delete "BEST MODE FOR CARRYING OUT THE INVENTION" and insert --DETAILED DESCRIPTION OF THE INVENTION--.

Column 5 Line 54 after "upper and lower" insert --ends--.

Column 6 Line 2 after "50 mm" delete "are required" and insert --is--.

Column 8 Line 3 "discharged" should read --discharge--.

Column 11 Line 29 Claim 1 after "oven" insert comma --,--.

Signed and Sealed this

Seventh Day of July, 1998

Bruce Lehman

*Attest:*

BRUCE LEHMAN

*Attesting Officer*

*Commissioner of Patents and Trademarks*